US007540339B2

(12) United States Patent
Kollé

(10) Patent No.: US 7,540,339 B2
(45) Date of Patent: Jun. 2, 2009

(54) SLEEVED HOSE ASSEMBLY AND METHOD FOR JET DRILLING OF LATERAL WELLS

(75) Inventor: Jack J. Kollé, Seattle, WA (US)

(73) Assignee: Tempress Technologies, Inc., Kent, WA (US)

( * ) Notice: Subject to any disclaimer, the term of this patent is extended or adjusted under 35 U.S.C. 154(b) by 353 days.

(21) Appl. No.: 11/345,655

(22) Filed: Feb. 1, 2006

(65) Prior Publication Data

US 2006/0169495 A1 Aug. 3, 2006

Related U.S. Application Data

(60) Provisional application No. 60/649,374, filed on Feb. 1, 2005.

(51) Int. Cl.
*E21B 7/18* (2006.01)
*E21B 7/08* (2006.01)

(52) U.S. Cl. ..... 175/67; 175/424; 138/125

(58) Field of Classification Search ..... 138/125; 285/261, 263, 272, 146.1, 147.1, 147.3, 147.2; 175/67, 424
See application file for complete search history.

(56) References Cited

U.S. PATENT DOCUMENTS

| | | | | | |
|---|---|---|---|---|---|
| 1,748,817 | A | * | 2/1930 | Zerk | 285/9.2 |
| 2,885,182 | A | * | 5/1959 | Hering | 175/80 |
| 3,475,039 | A | * | 10/1969 | Ortloff | 285/45 |
| 4,007,797 | A | | 2/1977 | Jeter | 175/26 |
| 4,402,551 | A | | 9/1983 | Wood et al. | 299/5 |
| 4,440,242 | A | | 4/1984 | Schmidt et al. | 175/107 |
| 4,979,577 | A | | 12/1990 | Walter | 175/56 |
| 4,997,159 | A | | 3/1991 | Yoshino et al. | 251/29 |
| 5,467,834 | A | | 11/1995 | Hughes et al. | 175/61 |
| 5,740,127 | A | | 4/1998 | Van Steenwyk et al. | 367/85 |
| 6,065,540 | A | * | 5/2000 | Thomeer et al. | 166/297 |
| 6,109,306 | A | * | 8/2000 | Kleinert | 138/127 |
| 6,237,701 | B1 | | 5/2001 | Kollé et al. | 175/1 |
| 6,464,258 | B2 | * | 10/2002 | Shin | 285/49 |
| 2003/0151975 | A1 | | 8/2003 | Zhou et al. | 367/31 |

FOREIGN PATENT DOCUMENTS

EP 0361639 B1 9/1995

OTHER PUBLICATIONS

Parker Hannifin Corporation. "Polyflex Hose Products." Catalog 4900 USA, Jun. 2003. Page B13 and p. B125.

* cited by examiner

*Primary Examiner*—David J Bagnell
*Assistant Examiner*—Robert E Fuller
(74) *Attorney, Agent, or Firm*—Ronald M. Anderson

(57) ABSTRACT

A sleeved hose assembly for lateral jet drilling through an ultra-short radius curve. The sleeved hose assembly includes a wire-wound high-pressure hose inserted inside a reinforcing sleeve. In general, wire-wound high-pressure hoses exhibit transverse moduli that are insufficient to resist buckling forces encountered during lateral drilling. A sleeve is selected to encompass a wire-wound high-pressure hose and to exhibit a transverse stiffness sufficient to prevent the combination of the wire-wound high-pressure hose and the sleeve (i.e., a "sleeved hose assembly") from buckling during lateral drilling. Also disclosed are a method for drilling a lateral borehole using such a sleeved hose assembly, and a method for drilling an ultra-short radius curve using such a sleeved hose assembly. In a particularly preferred exemplary embodiment, the sleeve includes a fiber reinforced epoxy composite having a transverse modulus of about 10 GPa.

28 Claims, 5 Drawing Sheets

SLEEVED HOSE ASSEMBLY AND METHOD FOR JET DRILLING OF LATERAL WELLS

RELATED APPLICATIONS

This application is based on a prior provisional application Ser. No. 60/649,374, filed on Feb. 1, 2005, the benefit of the filing date of which is hereby claimed under 35 U.S.C. § 119(e).

BACKGROUND

Large numbers of older oil wells in the U.S. bypassed relatively thin oil-bearing formations, whose recovery was not economical at the time those wells were drilled. Production of oil from formations that were thus bypassed represents a significant opportunity in an era of higher oil prices. Many of these previously bypassed zones are now being reworked. Oil production from thin zones and depleted older producing zones is commonly accompanied by substantial water production. Hydraulic fracturing is the principal technique for stimulating production from thin zones and depleted fields. This technique typically results in a pair of vertical wing fractures extending into the formation. In thin zones or depleted formations, the fractures commonly intersect water-bearing formations, resulting in the recovery of oil cut with water. The cost of separating the oil from the recovered oil and water mixture, and disposing of the water, is significant.

Jet drilling rotors are capable of drilling porous rock such as sandstone, with low thrust and zero mechanical torque. These tools can be made very compact, enabling the tools to conform to a small bend radius. Ultra-short radius jet drilling offers the potential to drill production holes entirely within the oil- or gas-bearing volume of a producing formation, or within a previously bypassed formation, such as those noted above. This approach should minimize the amount of water recovered with the oil, while simultaneously enabling the recovery of oil from a relatively large area.

Lateral completion wells in thin producing zones with good vertical permeability provide the greatest potential for increased production relative to vertical wells. The target formations for lateral drilling are typically relatively thin (i.e., ranging from about 2 to about 10 meters in thickness) formations that were bypassed in existing production wells. Jet drilling tools provide effective drilling at minimal thrust in permeable oil and gas producing formations, but may not effectively drill through impermeable cap-rock. The objective when drilling such formations is to drill a curved well within the formation thickness, implying the need to drill around a short radius curve having a minimum radius of about 1 meter (40 inches). Working within such a tight radius cannot be achieved using small diameter steel or titanium coiled tubing without exceeding the elastic yield of the tubing and generating a set bend that prevents subsequent straight hole drilling. Composite tubing capable of elastic bending through a small bend radius is available (for example, from Hydril Advanced Composites Group of Houston, Tex.). Unfortunately, such composite tubing generally exhibits maximum pressure ratings of about 35 MPa (~5000 psi), which is too low for many jet drilling objectives. Wire-wound high-pressure hose capable of bending though a short radius is also available (for example, from the Parflex Division of the Parker Hannifin Corporation in Ravenna, Ohio). Unfortunately, such wire-wound high-pressure hose is very flexible, and will buckle if employed to drill lateral completion wells. It would therefore be desirable to provide a hose assembly configured to deliver high-pressure jetting fluid to a jet drilling tool, where the hose assembly is sufficiently flexible to pass through a short radius curve without damage or acquiring a permanent set, yet is stiff enough to drill a long lateral extension without buckling or locking up in the hole.

SUMMARY

Disclosed herein is a sleeved hose assembly configured to facilitate the drilling of a long lateral extension through a short radius curve without buckling. As noted above, conventional wire-wound high-pressure hoses are not configured to exhibit transverse moduli sufficient to prevent such buckling from occurring during the drilling of a long lateral extension. The sleeved hose assembly disclosed herein includes both a wire-wound high-pressure hose having a transverse stiffness insufficient to prevent such buckling from occurring, and a sleeve having a transverse stiffness that is sufficient to prevent such buckling from occurring. The wire-wound high-pressure hose is inserted into the sleeve to achieve a sleeved hose assembly having a transverse stiffness sufficient to prevent buckling. As disclosed in greater detail below, a critical buckling load can be determined for a particular drilling application. Based on the critical buckling load that is thus determined, an adequate sleeve material can be selected. In a particularly preferred embodiment, the sleeve material exhibits a transverse modulus of at least about 10 GPa. It should be recognized however, that such a figure is intended to be exemplary, rather than limiting. Carbon fiber reinforced epoxy composites can be used to provide the sleeve, although other types of reinforcing fibers, such as fiberglass or aramid fiber, may be employed. The use of composite sleeve materials also reduces the weight and sliding friction resistance of the sleeved hose assembly, which allows drilling of longer laterals before buckling occurs. Because the composite material retains its elasticity, it will straighten upon exiting the curve, allowing straight drilling of lateral holes.

Also disclosed herein is a method for drilling a short radius curve using such a sleeved hose assembly and a method for drilling a lateral borehole using such a sleeved hose assembly.

Another aspect of this novel approach is directed to a method for drilling an ultra-short radius curve using a rotating jetting tool with a bent housing. The method includes the steps of selecting a wire-wound high-pressure hose capable of withstanding a fluid pressure required to operate the rotating jetting tool that will be used to drill the ultra-short radius curve. A sleeve is selected that is capable of jacketing the wire-wound high-pressure hose. The wire-wound high-pressure hose is then inserted into the sleeve to achieve a sleeved hose assembly. A drill string including the sleeved hose assembly and the rotating jetting tool is assembled, and the drill string is inserted into a borehole. The jetting tool incorporates a bent housing to facilitate drilling of the curved hole. A pressurized fluid is introduced into the sleeved hose assembly to energize the rotating jetting tool. The rotating jetting tool is then used to drill the short radius curve.

The method for drilling the lateral borehole includes the steps of selecting a wire-wound high-pressure hose capable of withstanding a fluid pressure required to operate a drilling tool to be used to drill the lateral drainage borehole, wherein a transverse stiffness of the wire-wound high-pressure hose is insufficient to prevent buckling of the wire-wound high-pressure hose during lateral drilling. A sleeve is selected that is capable of jacketing or encompassing the wire-wound high-pressure hose, and having a transverse stiffness sufficient to prevent buckling of the wire-wound high-pressure hose when jacketed/encompassed by the sleeve during lateral drilling. The wire-wound high-pressure hose is then inserted into the sleeve to achieve a sleeved hose assembly. A drill string is assembled that includes the sleeved hose assembly and a straight drilling tool, and the drill string is inserted into a borehole. A pressurized fluid is introduced into the sleeved hose assembly to energize the drilling tool, and the drilling tool is used to drill the lateral drainage borehole, without danger of the wire-wound high-pressure hose buckling during the lateral drilling.

Alternatively, a mechanism may be incorporated into the bent housing, which causes it to straighten when subjected to a change in pressure or axial load. For example, the housing could incorporate a knuckle joint that bends at high load, enabling the tool to drill a curve, but then straighten at a lower load, enabling straight hole drilling. Exemplary (but not limiting) high load (or high pressure) conditions can range from about 1000 psi to about 10,000 psi, while exemplary (but not limiting) low load (or low pressure) conditions can range from about 0 psi to about 500 psi. Those of ordinary skill in the art will readily recognize that such a pressure/load actuated bendable housing can be configured to predictably respond to various pressure/load conditions.

Because such ultra-short radius curves are particularly useful for drilling lateral extensions in relatively thin producing zones, additional desirable steps include selecting a sleeve having a transverse stiffness sufficient to prevent the wire-wound high-pressure hose from buckling during the short radius curve drilling, and drilling lateral extensions beyond the short radius curve.

This Summary has been provided to introduce a few concepts in a simplified form that are further described in detail below in the Description. However, this Summary is not intended to identify key or essential features of the claimed subject matter, nor is it intended to be used as an aid in determining the scope of the claimed subject matter.

DRAWINGS

Various aspects and attendant advantages of one or more exemplary embodiments and modifications thereto will become more readily appreciated as the same becomes better understood by reference to the following detailed description, when taken in conjunction with the accompanying drawings, wherein:

FIG. 1 (Prior Art) schematically illustrates a conventional wire-wound high-pressure hose that is sufficiently flexible to be used for lateral drilling, but which is not stiff enough to be used for lateral drilling without buckling;

FIG. 2 schematically illustrates a sleeved hose assembly that includes a wire-wound high pressure hose encompassed in a structural sleeve configured to prevent buckling of the sleeved hose assembly during lateral drilling;

FIG. 3 is a cross sectional view of the sleeved hose assembly of FIG. 2;

FIG. 4A schematically illustrates placement of a whipstock assembly in a vertical well;

FIG. 4B schematically illustrates milling of a window in the casing of a vertical well;

FIG. 4C schematically illustrates spooling of the sleeved hose assembly into the well;

FIG. 4D schematically illustrates a spring-biased housing of a rotary jetting tool being bent as it is loaded against a whipstock;

FIG. 4E schematically illustrates drilling of a short radius curve, with the spring-biased housing of the rotary jetting tool of FIG. 4D in the bent position;

FIG. 4F schematically illustrates drilling of a straight lateral hole, with the spring-biased housing of the rotary jetting tool of FIG. 4D in the straight position;

Figure 7A:
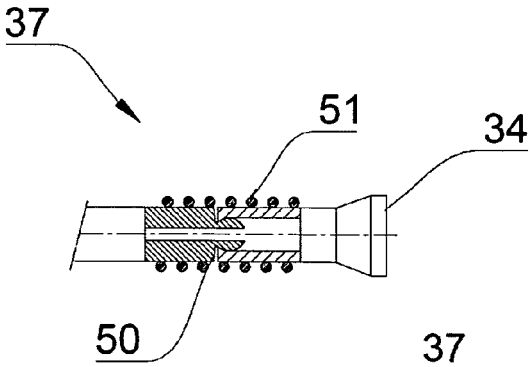
Figure 7B:
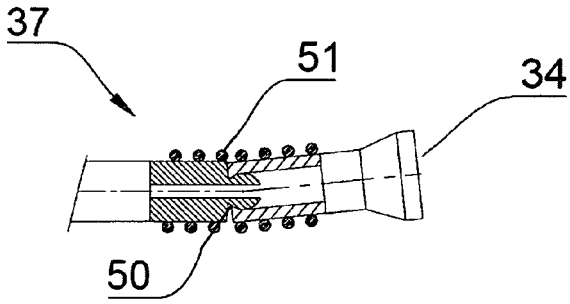
Figure 8:
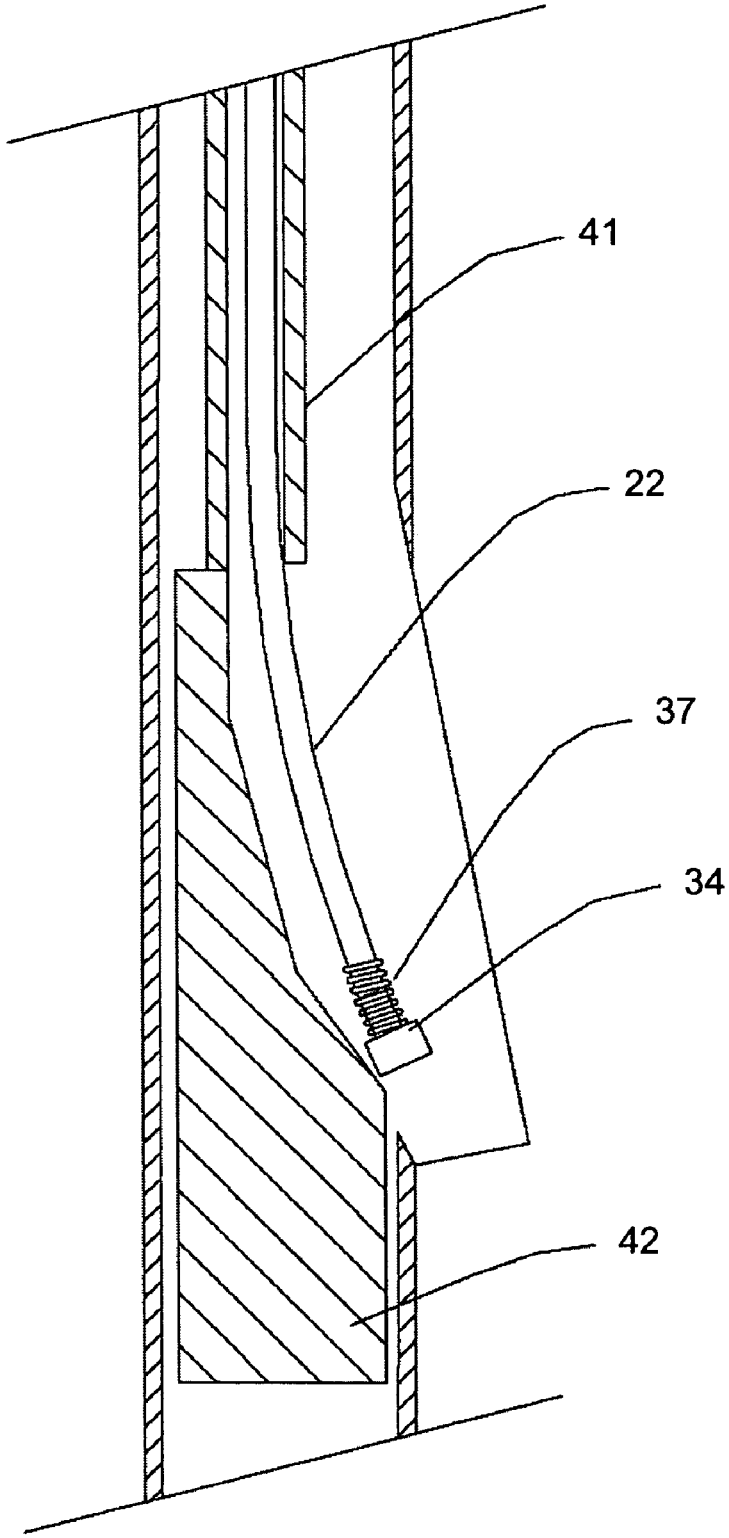

FIG. 7A schematically illustrates a spring-biased housing in a straight configuration;

FIG. 7B schematically illustrates a spring-biased housing in a bent configuration; and FIG. 8 schematically illustrates a spring-biased housing being bent by a whipstock.

DESCRIPTION

Figures and Disclosed Embodiments Are Not Limiting

Exemplary embodiments are illustrated in referenced Figures of the drawings. It is intended that the embodiments and Figures disclosed herein are to be considered illustrative rather than restrictive.

Figure 1:
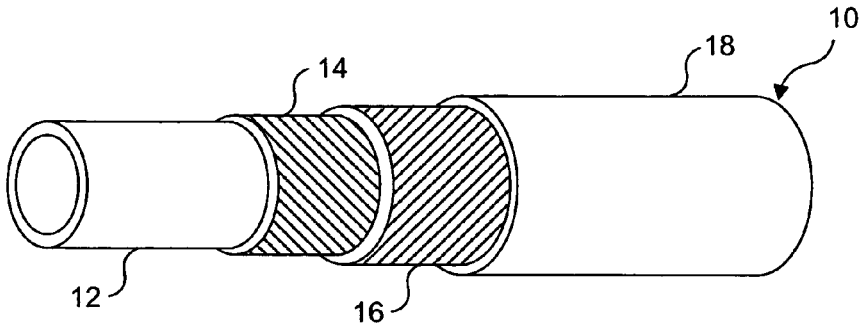
FIG. 1 (PRIOR ART)

Those of ordinary skill in the art will readily recognize that FIG. 1 schematically illustrates a Prior Art wire-wound high-pressure hose 10. In its simplest form, a wire-wound hose includes an inner rubber or plastic hose 12 encapsulated by a metal sheath (preferably of wire or metal braid). Wire-wound high-pressure hose 10 includes two spiral-wound wire layers 14 and 16, and an outer protective layer 18. Additional spiral wound layers may be employed to provide higher pressure capacity. The material used to implement protective layer 18 generally depends upon the intended use of the wire-wound hose. When the wire-wound hose is intended to be used in corrosive environments, protective layer 18 typically comprises a polymer. When the wire-wound hose is intended to be used in environments where abrasion resistance is important, protective layer 18 typically comprises a layer of steel braid. Significantly, protective layer 18 in conventional wire-wound hoses is not intended to provide significant structural support. That is, the prior art does not teach or suggest that the material used for protective layer 18 should exhibit sufficient stiffness to enable wire-wound high-pressure hose 10 to be used for lateral drilling applications without buckling.

Figure 2:
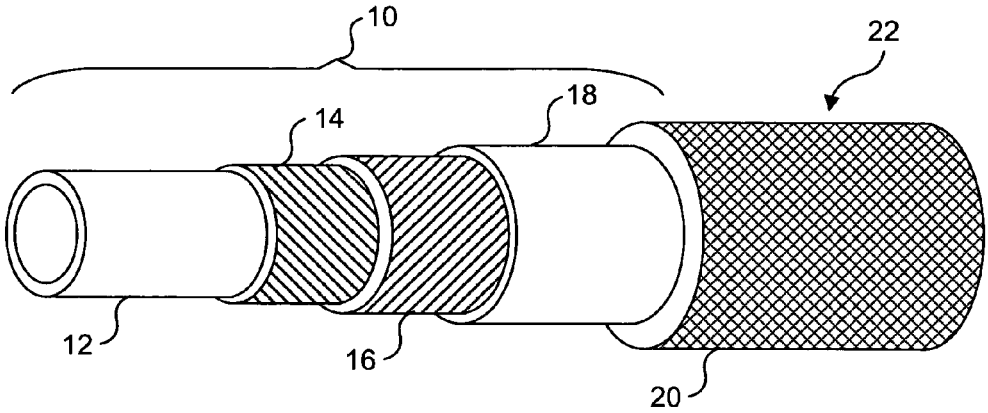

FIG. 2 schematically illustrates a sleeved hose assembly 22 specifically configured to facilitate the drilling of short radius lateral wells. Significantly, sleeved hose assembly 22 can be used with high-pressure fluids, is sufficiently flexible to achieve short radius bends (i.e., bends having a minimum radius of curvature of about 1 meter), and exhibits sufficient stiffness to prevent buckling during lateral drilling. Essentially, sleeved hose assembly 22 is achieved by jacketing wire-wound high-pressure hose 10 within a separate sleeve 20, where sleeve 20 comprises a material that exhibits a transverse stiffness sufficient to prevent buckling during lateral drilling. A particularly preferred material for sleeve 20 is a carbon fiber reinforced epoxy composite. Critical buckling loads for drilling applications and the transverse moduli required to enable lateral drilling without buckling are discussed in greater detail below. While carbon fiber reinforced epoxy composites represent a particularly preferred material for implementing sleeve 20, it should be recognized that such a material is intended to be exemplary, rather than limiting. Other materials having a sufficient transverse stiffness (as discussed in detail below) can also be beneficially employed. Particularly preferred materials will provide the required transverse stiffness, and will also be sufficiently flexible to traverse a short radius curve (i.e., a curve having a minimum radius of curvature of about 1 meter, and a maximum radius of up to about 10 meters).

Figure 3:
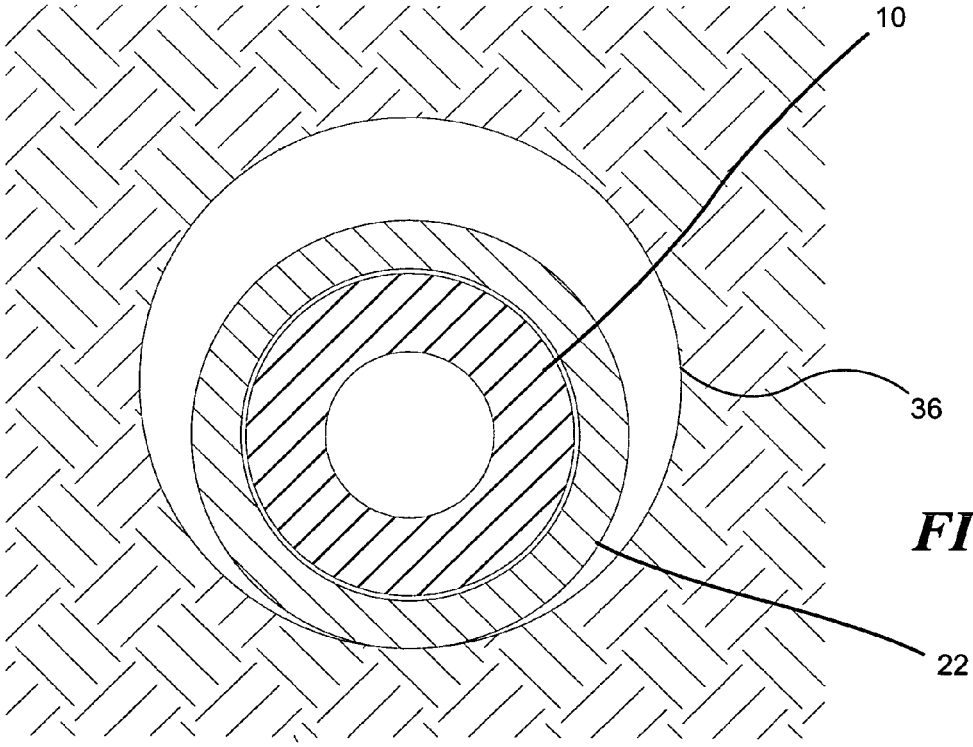

FIG. 3 is a cross-sectional view of sleeved hose assembly 22, including wire-wound high-pressure hose 10 and sleeve 20 inside a lateral bore 36. Preferably, wire-wound high-pressure hose 10 supports or enables pumping of fluid at pressures from about 20 MPa to about 400 MPa (i.e., from about 3,000 to about 60,000 psi).

Figure 4C:
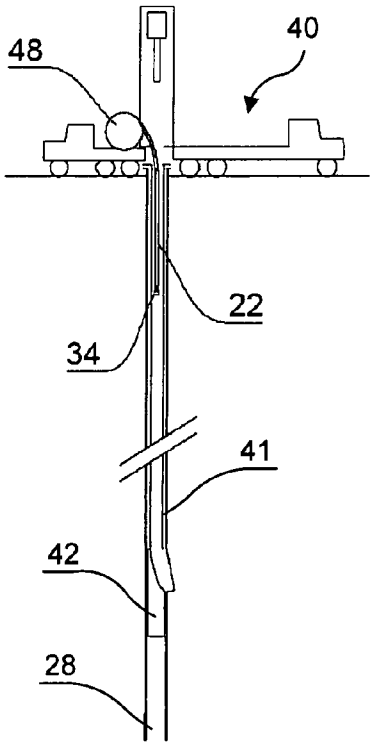
Figure 4B:
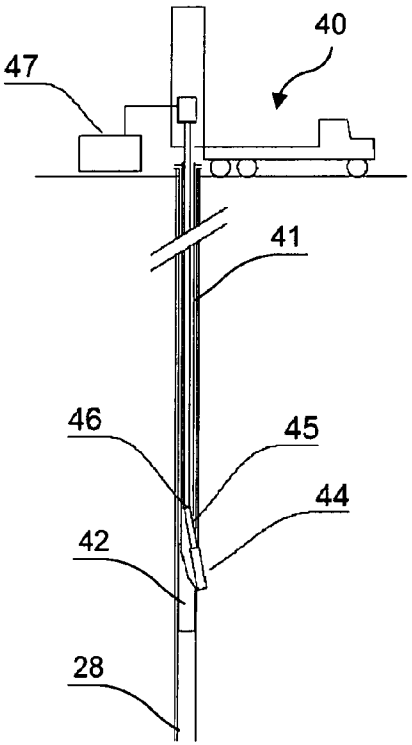
Figure 4A:
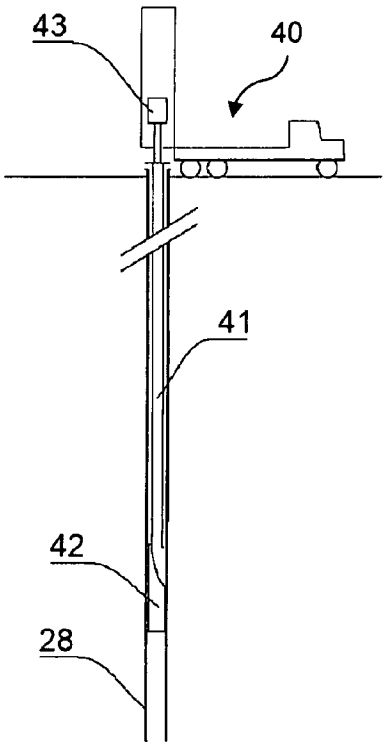

An exemplary deployment sequence for the sleeved hose assembly is schematically and sequentially illustrated in FIGS. 4A-4F. Referring to FIG. 4A, the sleeved hose assembly is preferentially deployed using a relatively low-cost workover rig 40, equipped with tools 43 for pulling and setting oil and gas production tubing. A first step, schematically illustrated in FIG. 4A, involves lowering a whipstock 42 mounted on a distal end of tubing 41 (preferably jointed tubing) into a well 28. The jointed tubing has an inside diameter that is equal to, or slightly larger than, the diameter of the lateral to be drilled, which helps to stabilize the sleeved hose assembly in the tubing and provides a high velocity flow path that helps facilitate transport of the cuttings liberated during drilling. Whipstock 42 is lowered to the desired depth, oriented azimuthally, and suspended in the well. If the well is cased at the depth of the desired lateral, a window may be milled into the casing using a hydraulic motor 45 and a mill 44 equipped with a knuckle joint 46 to allow milling of a relatively short window, as is schematically illustrated in FIG. 4B. Power for milling is supplied by a pump 47. If the well is not cased, this step (i.e., the window milling step shown in FIG. 4B) is not required.

Figure 4F:
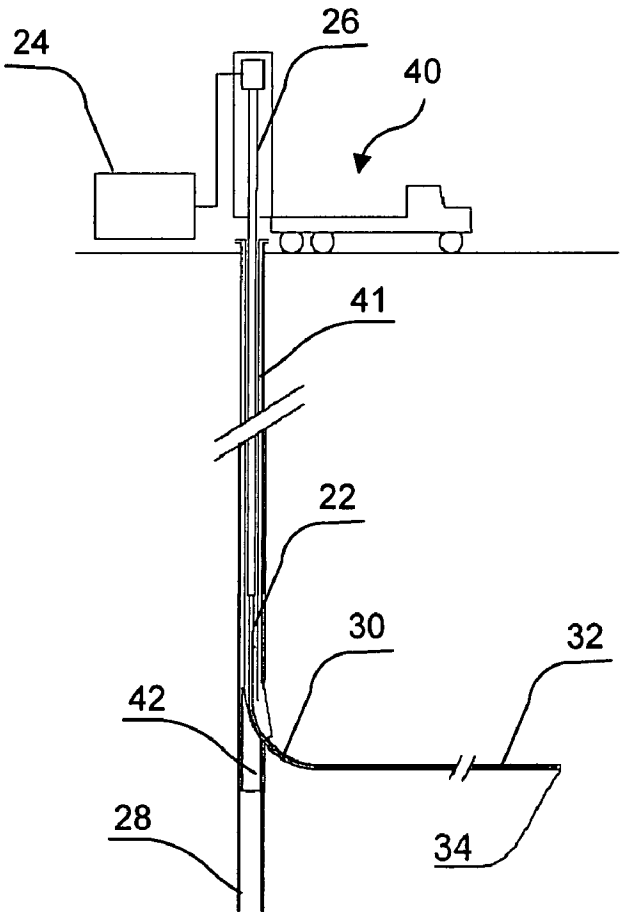
Figure 4F:
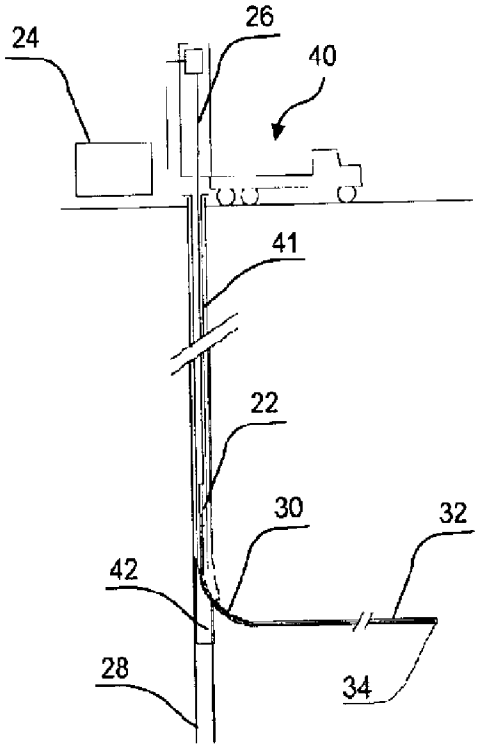
Figure 4E:
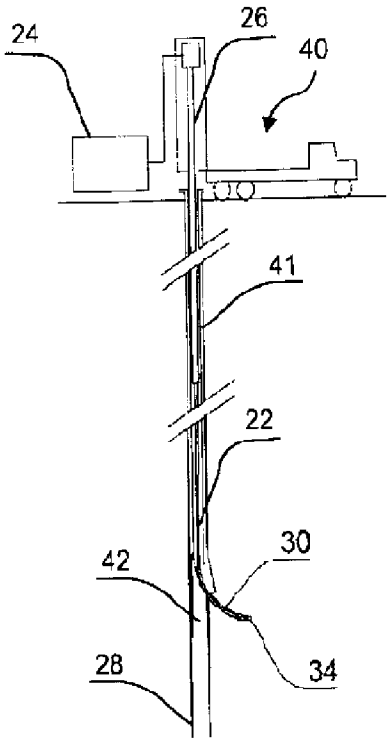
Figure 4D:
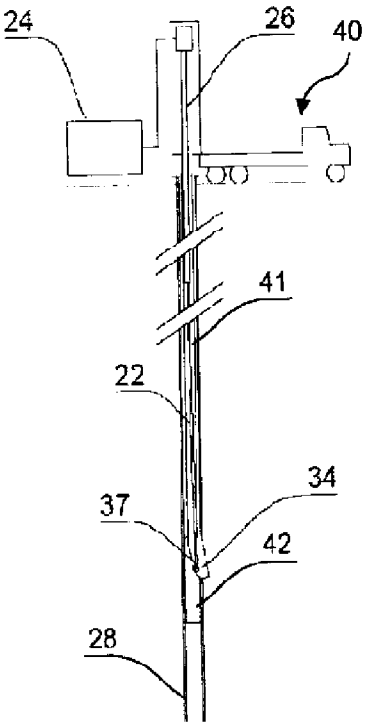

FIG. 4C schematically illustrates sleeved hose assembly 22 and a jet drill 34 (i.e., a rotary jetting tool) being spooled into well 28 from a reel 48. Jet drill 34 is disposed at a distal end of sleeved hose assembly 22. The proximal end of sleeved hose assembly 22 is then attached to a high pressure tubing 26, which is then tripped into well 28 by workover rig 40, as is schematically illustrated in FIG. 4D. When jet drill 34 encounters whipstock 42, a spring-biased housing 37 (details of which are provided below) is forced to bend. Bending is indicated on the surface by a decrease in the weight, which can readily be detected at workover rig 40. Drilling fluid is then supplied to jet drill 34 via a high-pressure pump 24 (through high pressure tubing 26 and sleeved hose assembly 22), which causes spring-biased housing 37 to lock in the bent position. Once the pressure at the jet drill 34 reaches a level required to drill, the bend in spring-biased housing 37 will enable a short radius curved path 30 to be drilled, as is schematically illustrated in FIG. 4E. The tubing (high pressure tubing 26, sleeved hose assembly 22, spring-biased housing 37, and jet drill 34) is advanced through a distance equal to an arc required to incline the drill to a desired inclination (90 degrees for the case illustrated in FIG. 4E), to allow drilling of a horizontal lateral.

At this point, high-pressure pump 24 is stopped, so that the pressure in high pressure tubing 26, sleeved hose assembly 22, and jet drill 34 decreases. The tubing (high pressure tubing 26, sleeved hose assembly 22, spring-biased housing 37, and jet drill 34) is then un-weighted and pulled up slightly, to allow the bend in spring-biased housing 37 to straighten. Once the bend in spring-biased housing 37 is removed, the now straight housing enables: a lateral well extension 32 to be drilled, as is schematically illustrated in FIG. 4F. The process can be repeated multiple times without tripping sleeved hose assembly 22 out of well 28. Once the lateral well extension is complete, sleeved hose assembly 22, spring-biased housing 37, and jet drill 34 are retracted into the jointed tubing 41. Whipstock 42 can then be repositioned at any desired depth or azimuth. Tubing hangers (not specifically shown) can be used to suspend high pressure tubing 26 in jointed tubing 41. Both strings (i.e., the first string comprising high pressure tubing 26, sleeved hose assembly 22, spring-biased housing 37, and jet drill 34, and the second string comprising jointed tubing 41) can then be indexed upwards by a single joint. An outer tubing joint can next be disconnected to expose an inner tubing joint. The inner tubing can be hung in the outer tubing, and the two upper joints of the tubing can be removed. Jet drilling can then resume, generally as shown in FIGS. 4D and 4E. This procedure is intended to be exemplary, and other related procedures will be apparent to those skilled in the art of handling concentric jointed tubing.

Figure 5:
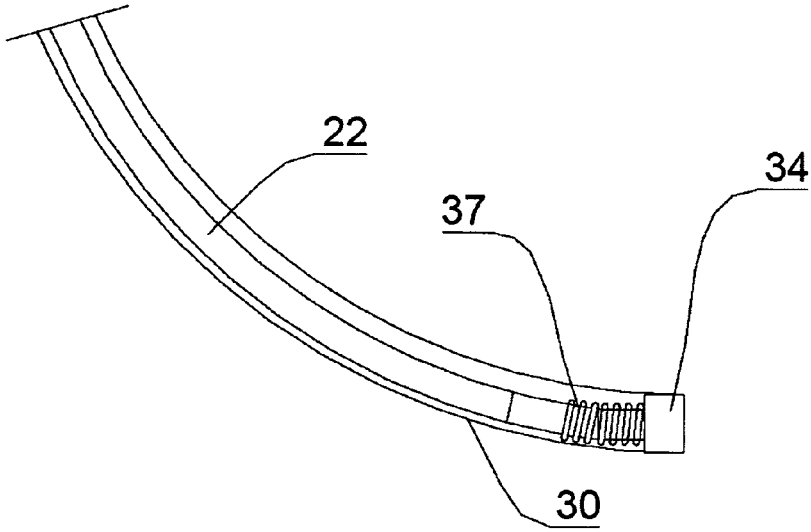
FIG. 5 illustrates a rotary jet drill incorporating a bent housing being used to drill a short radius curved hole.

FIG. 5 schematically illustrates short radius curved hole 30 being drilled by jet drill 34, which is attached to sleeved hose assembly 22 by spring-biased housing 37 (shown here in a bent configuration), generally as discussed above with respect to FIG. 4E. The radius of curvature of the hole will be defined by three points of contact, including jet drill 34, the outer diameter of spring-biased housing 37, and a point of contact somewhere along sleeved hose assembly 22. Those skilled in the art of directional drilling will recognize that stabilizers (preferably two) can be incorporated along the housing to define additional contact points, in order to define the radius of curvature more accurately.

Figure 6:
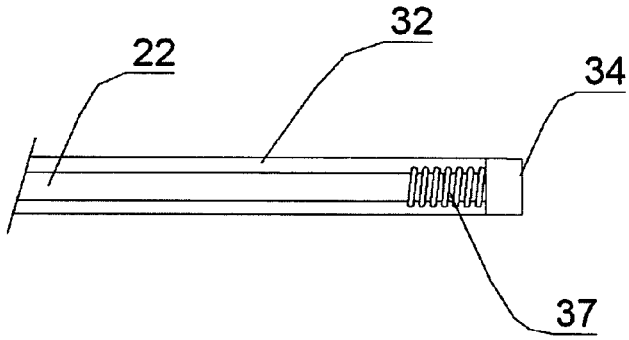
FIG. 6 illustrates a rotary jet drill incorporating a straight housing being used to drill a straight lateral hole.

FIG. 6 schematically illustrates lateral well extension 32 (a straight lateral hole) being drilled by rotary jetting tool 34, which is attached to sleeved hose assembly 22 by spring-biased housing 37 (shown here in a straight configuration), generally as discussed above with respect to FIG. 4F. Because the jet drill face is larger in diameter than the sleeved hose assembly, this configuration will tend to drill a hole with a slight upwards bend. Those skilled in the art will recognize that a stabilizer may be incorporated on the housing if a truly straight hole is desired.

FIG. 7A schematically illustrates spring-biased housing 37 in a straight configuration, while FIG. 7B schematically illustrates spring-biased housing 37 in a bent configuration. These Figures enable details of a preferred embodiment of spring-biased housing 37 to be visualized. This embodiment enables spring-biased housing 37 to transition from a curved or bent configuration (to enable the drilling of a curved hole) to a straight configuration (to enable drilling of a straight hole, such as a lateral extension) without pulling the assembly out of the hole. In such an embodiment, spring-biased housing 37 incorporates a knuckle joint 50 that includes a ball and a socket with internal flow passages. In these Figures, spring-biased housing 37 is shown with rotary jet drill 34 attached to its distal end. A spring 51 biases knuckle joint 50 to be straight when the tool is lying horizontally and is attached to the sleeved hose assembly. Alternative spring configurations will be apparent to those skilled in the art. The spring is sufficiently compliant that a side load on the nozzle head will cause the joint to bend as shown in FIG. 7B. For example, the spring can be sized to allow the knuckle joint to bend when the tool is forced at a load in excess of about 100 lbf into the angled whipstock shown in FIGS. 4A-4F (i.e., whipstock 42). The knuckle joint allows the tool to bend in the direction of the whipstock. When internal pressure is applied to the knuckle joint while it is bent, friction between the ball and socket is sufficient to lock the joint in the bent position. When pressure is applied to the knuckle joint while it is straight, friction between the ball and socket will lock the joint in the straight position.

FIG. 8 schematically illustrates spring-biased housing 37 being bent by a whipstock 42, generally as discussed above with respect to FIG. 4D. As jet drill 34 exits jointed tubing 41, it is deflected to the side by the slope of whipstock 42. When high pressure tubing 26 providing fluid to sleeved hose assembly 22 is substantially un-pressurized, the side load will cause spring biased housing 37 to bend. Exemplary (but not limiting) high load/high pressure conditions causing spring biased housing 37 to lock in a position can range from about 1000 psi to about 10,000 psi, while exemplary (but not limiting) low load/low pressure conditions enabling spring biased housing 37 to bend can range from about 0 psi to about 500 psi.

Exemplary Properties of the Sleeved Hose Assembly

The critical buckling load for a tube in a horizontal well (expressed in Newtons (N)) is defined as:

$$F_{crit} = 2\sqrt{\frac{EIw}{r}},$$

where E is the transverse stiffness of the tube material in Pascals (Pa), I is the beam section moment of inertia in $m^4$, w is the weight of the tube per unit length (expressed in N/m), and r is the radial clearance between the tube and the borehole (expressed in meters).

Steel wire-wound hose (i.e., wire-wound high-pressure hose 10) is used to provide mass, w, which helps to stabilize sleeved hose assembly 22 against buckling. In an exemplary preferred embodiment, sleeve 20 is formed of a carbon fiber reinforced epoxy composite material. The composite sleeve provides a substantially higher transverse stiffness obtained from the product of modulus, E, and moment of inertia, I, than is available from wire-wound high-pressure hose 10 alone. The composite sleeve (i.e., sleeve 20) also reduces the clearance, r, between the sleeve assembly and the borehole. In one particularly preferred exemplary embodiment, sleeved hose assembly 22 exhibits the following properties:

TABLE 1

| Exemplary Properties of Sleeved Hose Assembly | | |
|---|---|---|
| Wire-wound high-pressure hose 10 outer diameter | 25 | mm |
| Wire-wound high-pressure hose 10 inner diameter | 13 | mm |
| Wire-wound high-pressure hose 10 submerged weight | 3.1 | N/m |
| Wire-wound high-pressure hose 10 pressure capacity | 180 | MPa |
| Composite sleeve 20 inner diameter | 25.4 | mm |
| Composite sleeve 20 outer diameter | 33 | mm |
| Composite sleeve 20 transverse modulus | 10 | GPa |
| Minimum bend radius | 762 | mm |
| Lateral Hole diameter | 44 | mm |
| Critical buckling load | 1548 | N |

It should be recognized that the above identified properties are intended to be exemplary, rather than limiting. A rotary jet drill of this size may require 200 N of axial thrust for effective drilling. The additional thrust is used to overcome the frictional resistance due to the submerged weight of the sleeved hose in the borehole. Assuming a sliding friction coefficient of 0.5, this assembly could be used to drill an 800 m lateral without buckling.

Although the present invention has been described in connection with the preferred form of practicing it and modifications thereto, those of ordinary skill in the art will understand that many other modifications can be made to the present invention within the scope of the claims that follow. Accordingly, it is not intended that the scope of the invention in any way be limited by the above description, but instead be determined entirely by reference to the claims that follow.

The invention in which an exclusive right is claimed is defined by the following:

1. A sleeved hose assembly for lateral jet drilling through an ultra-short radius curve, comprising:

(a) a wire-wound high-pressure hose configured to accommodate a high-pressure fluid and to traverse an ultra-short radius curve;

(b) a sleeve jacketing the wire-wound high-pressure hose, the sleeve being formed of a material having a transverse stiffness sufficient to prevent buckling of the sleeved hose assembly during lateral jet drilling; and (c) a pressure responsive housing disposed at a distal end of the sleeved hose assembly, the pressure responsive housing being configured to:

(i) bend when a side load is applied to the pressure responsive housing and the pressure responsive housing is exposed to relatively low pressure conditions;

(ii) return to a generally straight configuration when a side load is substantially reduced, and the pressure responsive housing is exposed to relatively high pressure conditions; and (iii) lock into an existing configuration when the pressure responsive housing is exposed to relatively high pressure conditions.

2. The sleeved hose assembly of claim 1, wherein the sleeved hose assembly is capable of accommodating a critical buckling load for a lateral hole without buckling.

3. The sleeved hose assembly of claim 1, wherein the sleeved hose assembly is configured to traverse an ultra-short radius curve exhibiting a minimum radius of curvature of about 1 meter without acquiring a permanent bend.

4. The sleeved hose assembly of claim 1, wherein the sleeve comprises a composite material.

5. The sleeved hose assembly of claim 1, wherein the transverse modulus is at least about 10 GPa.

6. The sleeved hose assembly of claim 1, wherein the pressure responsive housing comprises:

(a) a knuckle joint movable between a bent configuration and a straight configuration, the knuckle joint being configured to:

(i) bend when a side load is applied and the knuckle joint experiences relatively low pressure conditions; and (ii) lock into an existing configuration when the knuckle joint experiences relatively high pressure conditions; and b) a spring configured to return the knuckle joint to a straight configuration when the side load is removed and the knuckle joint experiences relatively low pressure conditions.

7. A method of drilling a lateral drainage borehole, comprising the steps of:

(a) introducing a rotating jetting tool mounted on a distal end of a sleeved hose assembly into an existing well, wherein the sleeved hose assembly comprises:

(i) a wire-wound high-pressure hose configured to accommodate a high-pressure fluid and to traverse an ultra-short radius curve;

(ii) a sleeve jacketing the wire-wound high-pressure hose, the sleeve being formed of a material having a transverse stiffness sufficient to prevent buckling of the sleeved hose assembly during lateral jet drilling; and (iii) a pressure responsive housing disposed at a distal end of the sleeved hose assembly, the pressure responsive housing being configured to:

(A) bend when a side load is applied to the pressure responsive housing and the pressure responsive housing is exposed to relatively low pressure conditions;

(B) return to a generally straight configuration when a side load is substantially reduced, and the pressure responsive housing is exposed to relatively high pressure conditions; and (C) lock into an existing configuration when the pressure responsive housing is exposed to relatively high pressure conditions;

(b) introducing a pressurized fluid into the sleeved hose assembly to energize the rotary jetting tool, such that the rotary jetting tool emits a jet of pressurized fluid; and (c) using the jet of pressurized fluid to drill the lateral drainage borehole.

8. The method of claim 7, wherein the transverse modulus of the sleeve is at least about 10 GPa.

9. The method of claim 7, further comprising the step of drilling a short radius curve from the existing well before drilling the lateral drainage borehole.

10. The method of claim 9, wherein the step of drilling the short radius curve comprises the steps of:

(a) while the sleeved hose assembly is substantially unpressurized, deflecting the distal end of the sleeved hose assembly towards a side of the existing well, generally proximate to, but above a desired location of the lateral drainage borehole, thereby causing the distal end of the sleeved hose assembly to achieve a bent configuration;

(b) introducing a pressurized fluid into the sleeved hose assembly to energize the rotary jetting tool, such that:

(i) the pressurized fluid locks the distal end of the sleeved hose assembly into the bent configuration; and (ii) the rotary jetting tool emits a jet of pressurized fluid; and (c) drilling a curved hole extending beyond the existing well, using the jet of pressurized fluid.

11. The method of claim 10, wherein once the curved hole reaches the desired location of the lateral drainage borehole, further comprising the step of substantially removing the pressurized fluid from the sleeved hose assembly, thereby causing the distal end of the sleeved hose assembly to achieve a substantially straight configuration, such that when the pressurized fluid is introduced into the sleeved hose assembly to energize the rotary jetting tool, drilling of the lateral drainage borehole can be achieved.

12. A method of drilling a lateral drainage borehole, comprising the steps of:

(a) selecting a wire-wound high-pressure hose capable of withstanding a fluid pressure required to operate a drilling tool to be used to drill the lateral drainage borehole, wherein a transverse stiffness of the wire-wound high-pressure hose is insufficient to prevent buckling of the wire-wound high-pressure hose during lateral drilling;

(b) selecting a sleeve capable of encompassing the wire-wound high-pressure hose and having a transverse stiffness sufficient to prevent buckling of the wire-wound high-pressure hose when encompassed by the sleeve during lateral drilling;

(c) inserting the wire-wound high-pressure hose into the sleeve to achieve a sleeved hose assembly;

(d) adding a pressure responsive housing disposed to a distal end of the sleeved hose assembly, the pressure responsive housing being configured to:

(i) bend when a side load is applied to the pressure responsive housing and the pressure responsive housing is exposed to relatively low pressure conditions;

(ii) return to a generally straight configuration when a side load is substantially reduced, and the pressure responsive housing is exposed to relatively high pressure conditions; and (iii) lock into an existing configuration when the pressure responsive housing is exposed to relatively high pressure conditions;

(e) introducing a drill string comprising the sleeved hose assembly, the pressure responsive housing and the drilling tool into an existing borehole;

(f) introducing a pressurized fluid into the sleeved hose assembly to energize the drilling tool; and (g) using the drilling tool that is energized, to drill the lateral drainage borehole.

13. The method of claim 12, wherein the step of selecting the sleeve comprises the step of selecting a sleeve having a transverse modulus that is at least about 10 GPa.

14. The method of claim 12, wherein the step of selecting the sleeve comprises a step of selecting a sleeve comprising a fiber reinforced epoxy composite material.

15. The method of claim 12, wherein the step of selecting the wire-wound high-pressure hose comprises the step of selecting a wire-wound high-pressure hose capable of traversing an ultra-short radius curve having a radius of curvature of less than about 1 meter.

16. The method of claim 12, further comprising the step of drilling a short radius curve from the existing borehole before drilling the lateral drainage borehole.

17. The method of claim 16, wherein the step of drilling the short radius curve comprises the steps of:

(a) while the sleeved hose assembly is substantially unpressurized, deflecting the distal end of the sleeved hose assembly towards a side of the existing borehole, generally proximate to, but above a desired location of the lateral drainage borehole, thereby causing the distal end of the sleeved hose assembly to achieve a bent configuration;

(b) introducing a pressurized fluid into the sleeved hose assembly to energize the rotary jetting tool, such that:

(i) the pressurized fluid locks the pressure responsive housing at the distal end of the sleeved hose assembly into the configuration; and (ii) the rotary jetting tool emits a jet of pressurized fluid;

(c) drilling a curved hole extending beyond the existing borehole until the curved hole reaches the desired location of the lateral drainage borehole, using the jet of pressurized fluid; and (d) substantially removing the pressurized fluid from the sleeved hose assembly, thereby causing the pressure responsive housing at the distal end of the sleeved hose assembly to achieve a substantially straight configuration, such that when the pressurized fluid is introduced into the sleeved hose assembly to energize the rotary jetting tool, drilling of the lateral drainage borehole can be achieved.

18. A method of drilling an ultra-short radius curve using a rotating jetting tool, comprising the steps of:

(a) selecting a wire-wound high-pressure hose capable of withstanding a fluid pressure required to operate the rotating jetting tool to be used to drill the ultra-short radius curve;

(b) selecting a sleeve capable of encompassing the wire-wound high-pressure hose;

(c) inserting the wire-wound high-pressure hose into the sleeve to achieve a sleeved hose assembly;

(d) adding a pressure responsive housing disposed to a distal end of the sleeved hose assembly, the pressure responsive housing being configured to:

(i) bend when a side load is applied to the pressure responsive housing and the pressure responsive housing is exposed to relatively low pressure conditions;

(ii) return to a generally straight configuration when a side load is substantially reduced, and the pressure responsive housing is exposed to relatively high pressure conditions; and (iii) lock into an existing configuration when the pressure responsive housing is exposed to relatively high pressure conditions;

(e) introducing a drill string comprising the sleeved hose assembly, the pressure responsive housing and the rotating jetting tool into a borehole;

(f) introducing a pressurized fluid into the sleeved hose assembly to energize the rotating jetting tool; and (g) using the jetting tool that is rotating to drill the ultra-short radius curve.

19. The method of claim 18, further comprising the step of using the rotating jetting tool to drill a lateral extension beyond the ultra-short radius curve.

20. The method of claim 18, wherein a transverse stiffness of the wire-wound high-pressure hose is insufficient to prevent buckling of the wire-wound high-pressure hose during the drilling of the lateral extension, and wherein the step of selecting the sleeve comprises the step of selecting a sleeve having a transverse stiffness that is sufficient to prevent buckling of the wire-wound high-pressure hose when encompassed by the sleeve during the drilling of the lateral extension.

21. The method of claim 20, wherein the step of selecting the sleeve having the transverse stiffness that is sufficient to prevent buckling of the wire-wound high-pressure hose comprises the step of selecting a sleeve whose transverse modulus is at least about 10 GPa.

22. The method of claim 20, wherein the step of selecting the sleeve having the transverse stiffness that is sufficient to prevent buckling of the wire-wound high-pressure hose comprises the step of selecting a sleeve comprising a fiber reinforced epoxy composite.

23. The method of claim 18, wherein the step of using the rotating jetting tool to drill the ultra-short radius curve comprises the step of drilling a curve having a radius of curvature of less than about 1 meter.

24. A method of drilling a curved borehole using a rotary jetting tool, comprising the steps of:

(a) introducing a drill string comprising a hose assembly and the rotary jetting tool into an existing borehole, the hose assembly comprising a distal spring-biased knuckle joint assembly movable between a bent configuration and a straight configuration, the spring-biased knuckle joint assembly including:

(i) a knuckle joint configured to bend when a side load is applied and the knuckle joint experiences relatively low pressure conditions, and lock into an existing configuration when the knuckle joint experiences relatively high pressure conditions; and (ii) a spring configured to return the knuckle joint to a straight configuration when the side load is substantially reduced, and the knuckle joint experiences relatively low pressure conditions;

(b) while the hose assembly is substantially un-pressurized, deflecting a distal end of the hose assembly toward a side of the existing borehole, thereby causing a distal end of the hose assembly to achieve a bent configuration;

(c) introducing a pressurized fluid into the hose assembly to energize the rotary jetting tool and to expose the knuckle joint to relatively high pressure conditions, such that:

(i) the pressurized fluid locks the knuckle joint at the distal end of the hose assembly into the bent configuration; and (ii) the rotary jetting tool emits a jet of pressurized fluid; and (d) drilling a curved borehole extending beyond the existing borehole, using the jet of pressurized fluid.

25. The method of claim 24, wherein the step of deflecting the distal end of the hose assembly comprises the step of using a whipstock to deflect the distal end of the hose assembly.

26. The method of claim 24, further comprising the step of drilling a lateral extension beyond the curved borehole.

27. The method of claim 26, wherein the step of drilling the lateral extension comprises the steps of:

(a) substantially removing the pressurized fluid from the hose assembly, thereby causing the knuckle joint at the distal end of the hose assembly to achieve a substantially straight configuration;

(b) once the knuckle joint at the distal end of the hose assembly is in a substantially straight configuration, introducing the pressurized fluid into the hose assembly to energize the rotary jetting tool and to lock the knuckle joint at the distal end of the hose assembly in the substantially straight configuration; and (c) drilling the lateral extension using the rotary jetting tool.

28. The method of claim 24, wherein before the step of introducing the drill string comprising the hose assembly and the rotary jetting tool into the existing borehole, further comprising the steps of:

(a) selecting a wire-wound high-pressure hose capable of withstanding a fluid pressure required to operate the rotary jetting tool, wherein a transverse stiffness of the wire-wound high-pressure hose is insufficient to prevent buckling of the wire-wound high-pressure hose during lateral drilling;

(b) selecting a sleeve capable of encompassing the wire-wound high-pressure hose and having a transverse stiffness sufficient to prevent buckling of the wire-wound high-pressure hose when encompassed by the sleeve during lateral drilling;

(c) inserting the wire-wound high-pressure hose into the sleeve to achieve a sleeved hose assembly; and (d) coupling the rotary jetting tool to the sleeved hose assembly to achieve the drill string.

* * * * *

UNITED STATES PATENT AND TRADEMARK OFFICE

CERTIFICATE OF CORRECTION

PATENT NO. : 7,540,339 B2
APPLICATION NO. : 11/345655
DATED : June 2, 2009
INVENTOR(S) : Jack Kollé

It is certified that error appears in the above-identified patent and that said Letters Patent is hereby corrected as shown below:

Drawings: Page 3 of 5 The page containing FIGURE 4F should also display FIGURES 4D and 4E as shown on attached drawing sheet which was originally submitted at the time the application was filed.

Signed and Sealed this

Sixth Day of October, 2009

David J. Kappos

David J. Kappos
*Director of the United States Patent and Trademark Office*